United States Patent [19]

Juergens et al.

[11] 4,074,810

[45] Feb. 21, 1978

[54] COMBINATION TIERED LETTER TRAY AND VERTICAL FILE

[75] Inventors: David A. Juergens; Greg P. Terek, both of Winchester, Va.

[73] Assignee: Rubbermaid Commercial Products Inc., Winchester, Va.

[21] Appl. No.: 727,227

[22] Filed: Sept. 27, 1976

[51] Int. Cl.[2] ..... A47F 7/00

[52] U.S. Cl. ..... 211/11; 211/126

[58] Field of Search ..... 211/11, 10, 49, 50, 211/126, 128; 220/23.4, 23.6

[56] References Cited

U.S. PATENT DOCUMENTS

| | | | |
|---|---|---|---|
| 982,538 | 1/1911 | Senge | 211/126 |
| 2,235,709 | 3/1941 | Hearn et al. | 211/126 X |
| 2,334,825 | 11/1943 | Jones | 211/126 |
| 2,858,028 | 10/1958 | Hunting et al. | 211/126 |
| 2,902,166 | 9/1959 | Bahr | 211/11 |
| 3,028,975 | 4/1962 | Bullock | 211/126 |
| 3,047,157 | 7/1962 | Bergman | 211/126 |
| 3,482,708 | 12/1969 | Levit et al. | 211/126 |
| 3,533,512 | 10/1970 | Serwer | 211/126 |

FOREIGN PATENT DOCUMENTS

| | | | |
|---|---|---|---|
| 633,274 | 12/1961 | Canada | 211/126 |
| 384,143 | 10/1923 | Germany | 211/126 |
| 1,079,678 | 8/1967 | United Kingdom | 211/126 |

*Primary Examiner*—Roy D. Frazier
*Assistant Examiner*—Robert W. Gibson, Jr.
*Attorney, Agent, or Firm*—Hamilton, Renner & Kenner

[57] ABSTRACT

A tiered letter tray comprising at least two trays detachably stacked one upon another by rectangular plastic riser plates and a vertical file comprising at least one L-shaped trough having means at one side of its base for selective attachment to the side of the bottom letter tray, said trough adapted at the other side of its base for selective attachment to one side of a like trough, and an end cap adapted for selective attachment to said one side of the base for using said trough detached from said letter tray.

9 Claims, 9 Drawing Figures

COMBINATION TIERED LETTER TRAY AND VERTICAL FILE

BACKGROUND OF THE INVENTION

Conventional letter trays for desk top use are provided with means for stacking or tiering the trays one upon another but the stacking means has in some cases been unsightly, and in other cases difficult to manipulate, or both, and often the attaching means are complicated and expensive. Trays or file troughs for holding letters and envelopes in vertical position have been provided for desk top use, but those with which we are familiar are adapted only for use as separate units and have not been adapted for use in multiples or attached to a tiered letter tray.

SUMMARY OF THE INVENTION

The present invention provides an improved tiered letter tray and at least one improved vertical file trough adapted selectively to be attached to the bottom letter tray and to another like vertical file trough.

An object of the present invention is to provide improved means for stacking the letter trays.

Another object is to provide an improved vertical file trough having tabs on one side of its base and slots on the other side, whereby like file troughs can be connected in multiple.

A further object is to provide an improved letter tray having slots for selectively receiving the stacking means and the tabs of one of the improved vertical file troughs.

Another object is to provide an improved end cap adapted for attachment to the tabs of one of the improved vertical file troughs to adapt it for use as a separate unit.

A still further object is to provide an improved combination tiered letter tray and vertical file which is simple and inexpensive to manufacture, pleasing in appearance, and effectively useful separately or combined and in multiple.

These and ancillary objects are accomplished by the novel and improved constructions comprising the present invention, a preferred embodiment of which is shown by way of example in the accompanying drawings and described in detail in the following specification. Various modifications and changes in details of construction are intended to be within the scope of the appended claims.

DESCRIPTION OF A PREFERRED EMBODIMENT

Figure 1:
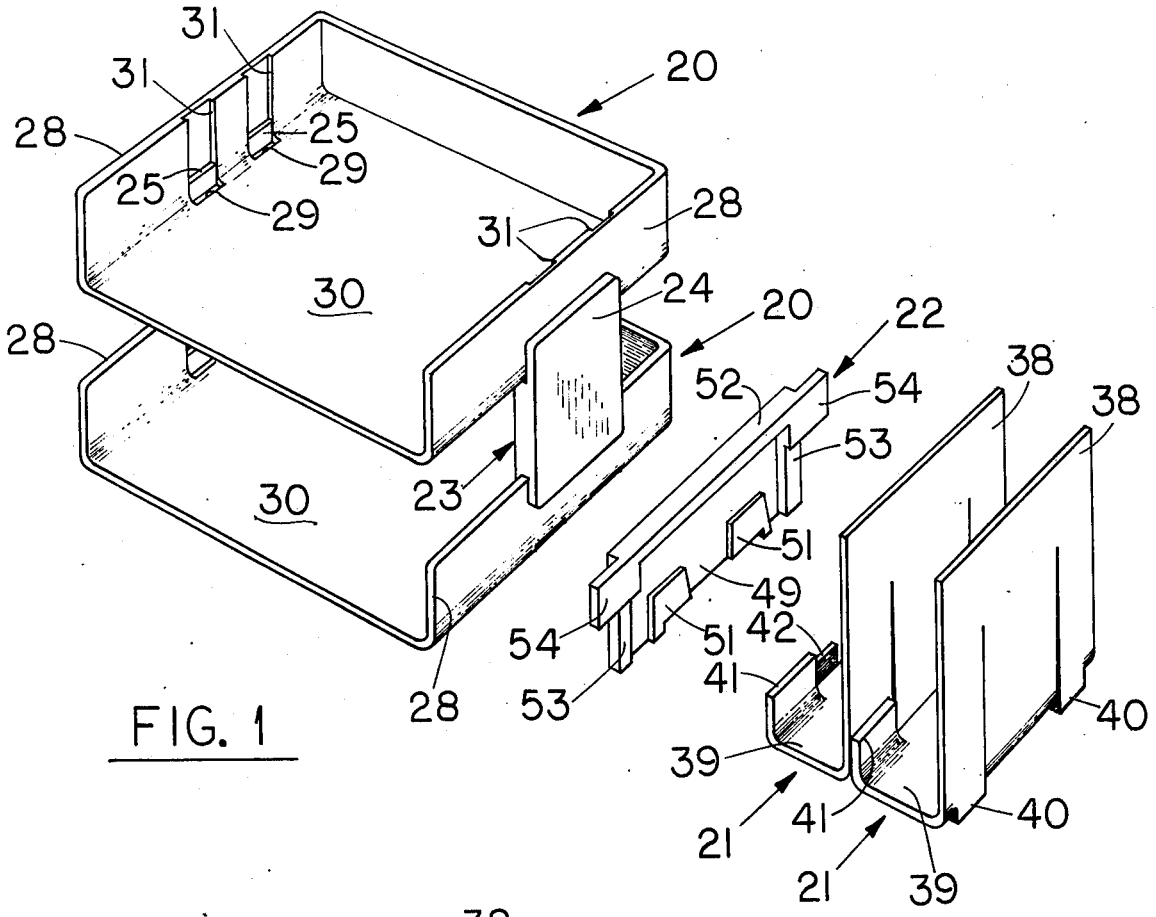
FIG. 1 is an exploded perspective view showing two of the improved letter trays tiered one upon the other, two of the improved vertical file troughs interconnected but detached from the letter trays, and a detached interior view of the end cap for the disconnected end of the adjacent file trough.
Figure 4:
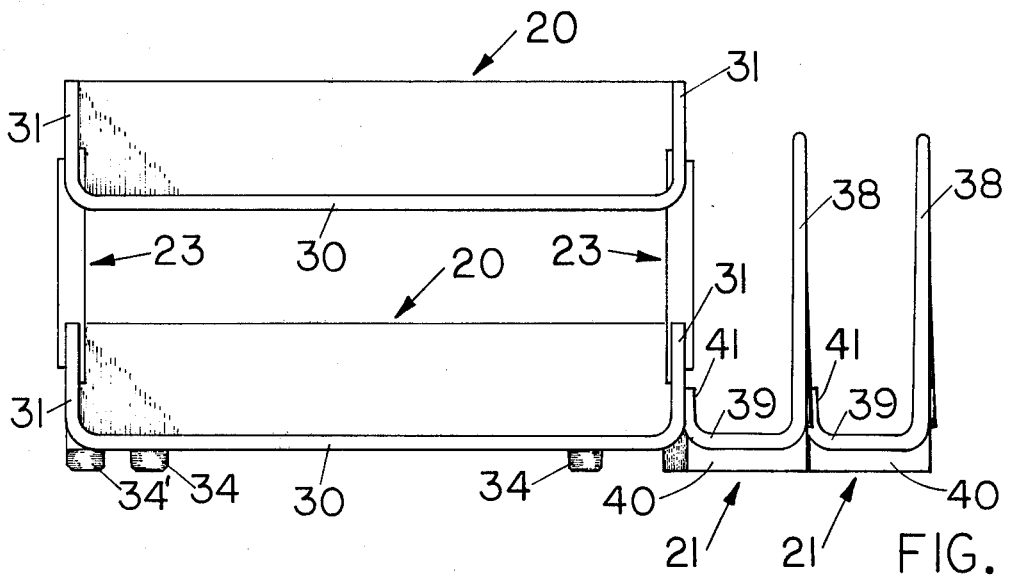
FIG. 4 is an end elevation of the two tiered letter trays with two interconnected vertical file troughs connected to the bottom letter tray.

Referring to FIGS. 1 and 4, the improved tiered letter trays indicated generally at 20 and two of the improved vertical file troughs indicated generally at 21 are shown respectively in exploded and interconnected relation. In FIG. 1 an end cap 22 is interposed in exploded relation to the end of an adjacent vertical file trough 21 on which it is selectively adapted to fit if the trough is used apart from the tiered letter trays.

Figure 3:
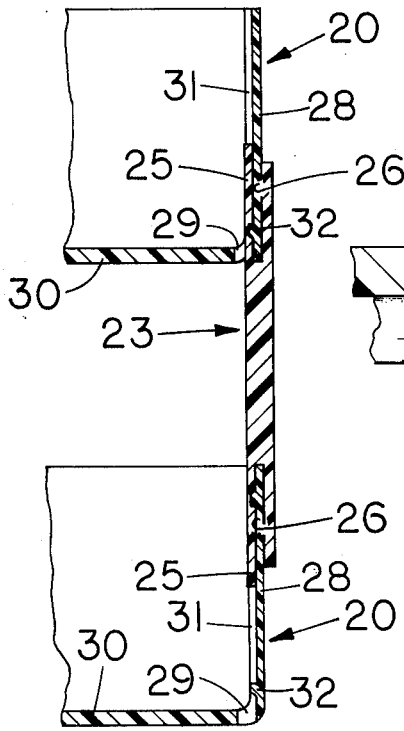
FIG. 3 is an enlarged partial vertical sectional view on line 3—3 of FIG. 2.
Figure 5:
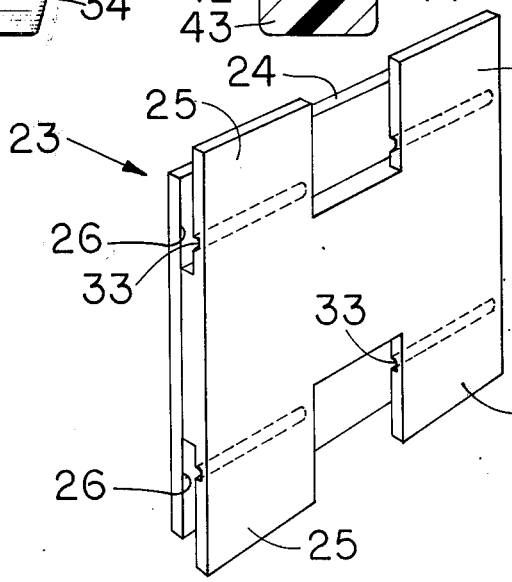
FIG. 5 (on the same sheet as FIG. 2) is a detached perspective view of one of the risers supporting the upper tray upon the lower tray.

The letter trays 20 are supported in stacked relation by two riser plate members indicated generally at 23. As best shown in FIG. 5, each riser 23 has an outer plate portion 24 and upper and lower spaced-apart rectangular tabs 25 spaced inwardly from the plate portion 24 by grooves 26 parallel to the plane of the plate portion 24 and the plane of the tabs 25. As best shown in FIG. 3, the lower groove 26 fits slidably over the upper edge portion of one side wall 28 of the lower tray 20 and the upper tabs 25 are slidably received through slots 29 in the bottom wall 30 of the upper tray at the intersection of the side wall 28 and the bottom wall.

Figure 2:
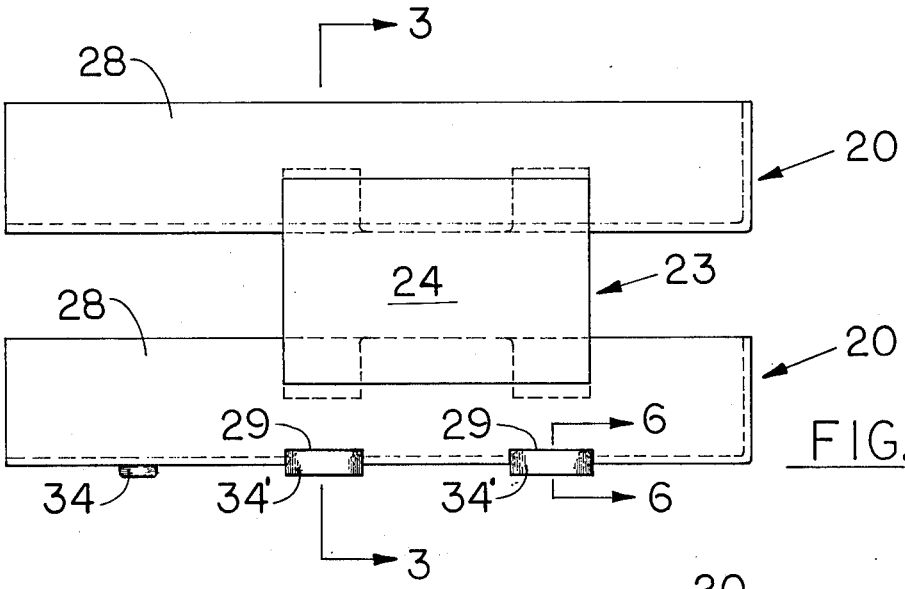
FIG. 2 is a side elevation of the two tiered letter trays.

The slots 29 merge into vertical grooves 31 in the interior surfaces of the side walls 28 and the upper tabs 25 extend through the slots and into the grooves of the upper tray, while the lower tabs 25 are slidably and frictionally engaged in the grooves 31 of the lower tray. Preferably, horizontal ribs 32 traverse the grooves 31 immediately above the slots 29, and horizontal grooves 33 on the interior of tabs 25 are located to snap over and engage the ribs 32 of the upper tray 20 to positively interlock the tabs into the upper tray. The frictional fit of the side wall 28 of the lower tray in the groove 26 between the lower tabs and the outer plate 24 and the frictional engagement of the lower tabs in the grooves 31 provides a stable connection between the risers 23 and the lower tray. As shown in FIGS. 2 and 4, the bottom wall of the lower tray preferably has feet 34 of rubber or the like for resting on a supporting surface. Additional feet 34' may be inserted as needed in the slots 29.

Figure 7:
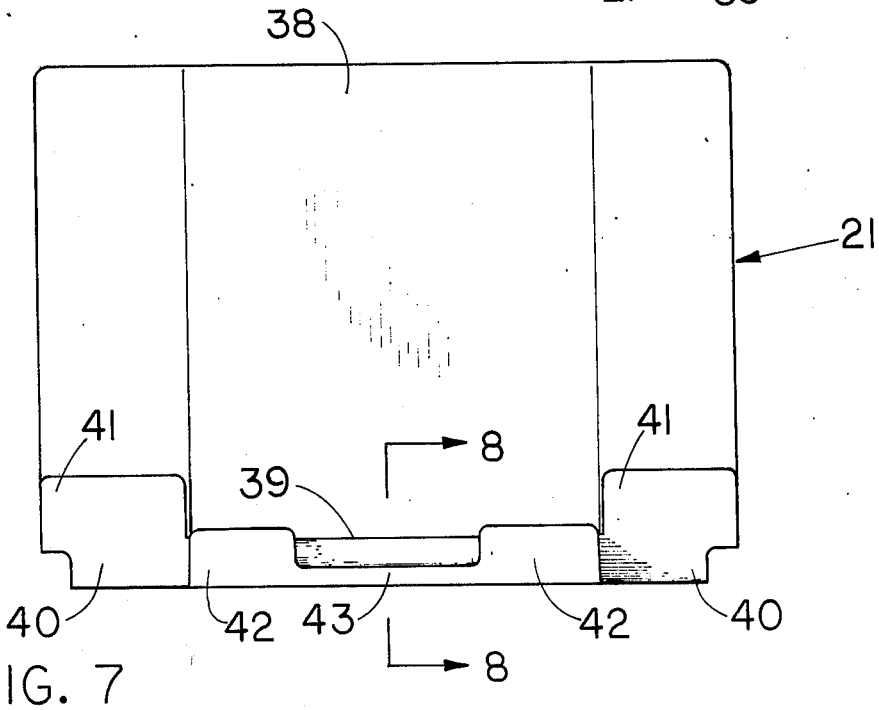
FIG. 7 (on the same sheet as FIG. 1) is an end elevation of the improved file trough.

The vertical file troughs 21 are substantially L-shaped and each have a rear vertical wall 38 connected to a horizontal bottom wall 39. The bottom wall has laterally spaced base ribs 40 traversing the underside of the bottom wall and spacing it above the supporting surface. At opposite ends of the front edge of bottom wall 39 are upstanding stabilizing ears 41 for abutting the rear wall 38 of an interconnected trough, and between ears 41 are two laterally spaced upright tabs 42 joined to the bottom wall and spaced forwardly thereof by a base rib 43 so as to form upwardly open grooves 44 (FIGS. 7 and 8) between the tabs and the front edge of the bottom wall 39. At the intersection of bottom wall 39 and rear wall 38 the bottom wall is provided with two laterally spaced slots 45 which are aligned across the bottom wall with the tabs 42, and the slots 45 are spaced apart the same distance as slots 29 in trays 20.

Figure 6:
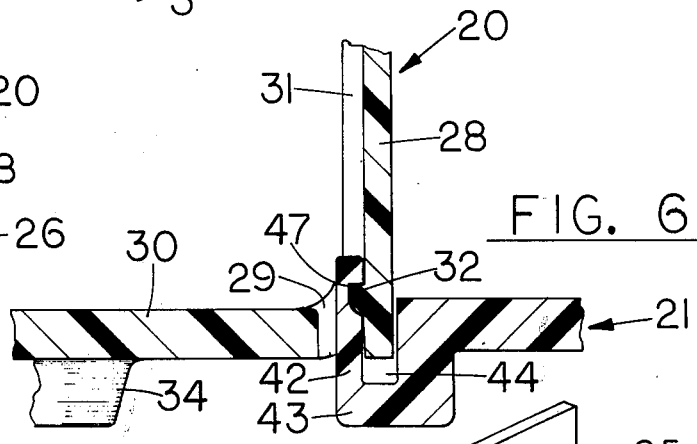
FIG. 6 is an enlarged partial sectional view as on line 6—6 of FIG. 2, and showing the tabs of a vertical file trough connected to the bottom tray.
Figure 8:
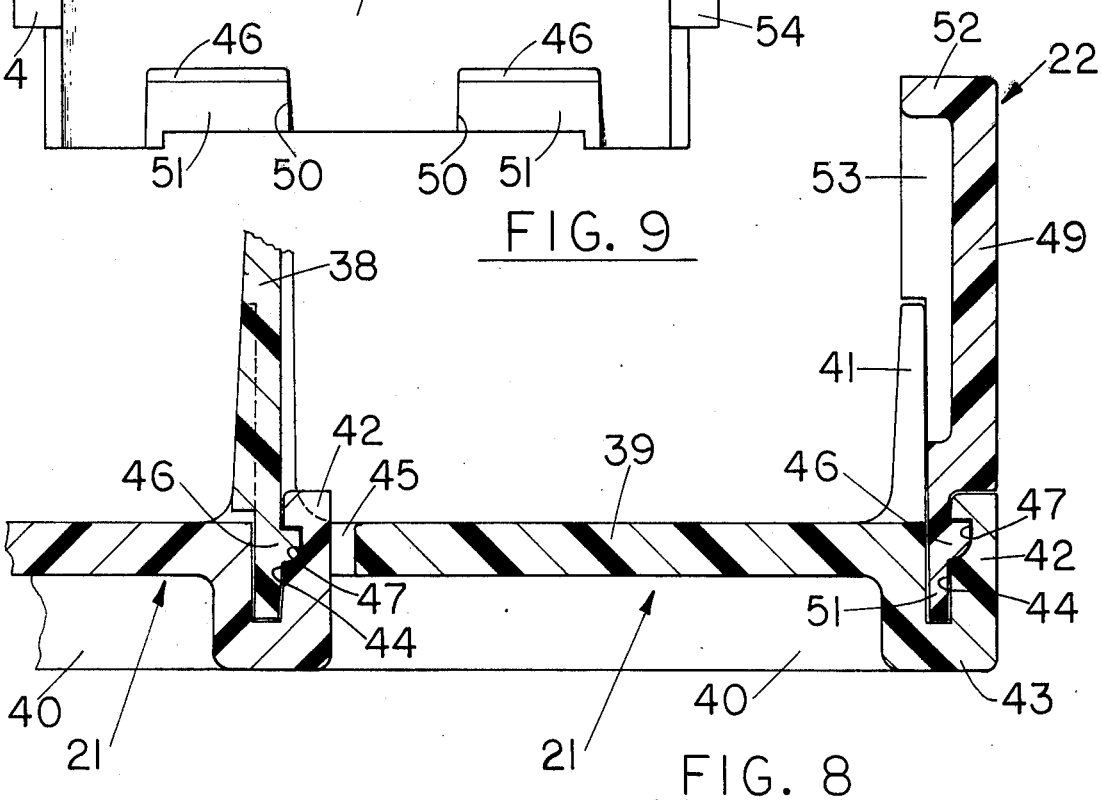
FIG. 8 (on the same sheet as FIG. 4) is an enlarged partial sectional view as on line 8—8 of FIG. 7, with the front tabs thereof inserted into the improved end cap, and the front tabs of a like trough inserted through bottom slots at the back wall of the first trough.

As shown in FIG. 8, the tabs 42 preferably have transverse grooves 47 across their inner surfaces, and within the slots 45 the rear wall 38 has transverse ribs 46 for interlocking into the grooves 47 when two like troughs are interconnected as in FIGS. 1 and 4, in which case the stabilizing ears 41 of one trough abut the rear wall of another. As shown in FIG. 6, the tabs 42 are adapted selectively to be received in slots 29 of the bottom tray 20 for connecting one or more vertical file troughs thereto, as in FIG. 4, in which case the grooves 47 interlock with the ribs 32 on the inner surface of a side wall 28 of the tray.

Figure 9:
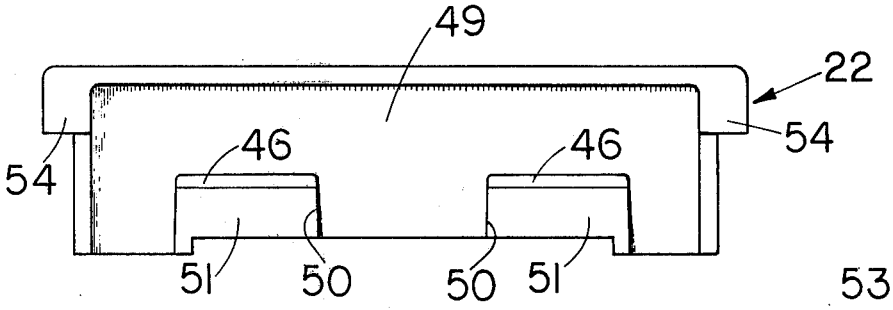
FIG. 9 is a detached exterior elevational view of the improved end cap.

The end cap 22 is provided for fitting over the front end of a trough 21 when it is used singly or in multiple and detached from the tiered letter trays 20. As seen in FIG. 9, the end cap has a front wall 49 with two recessed portions 50 in its front surface for fitting over the front tabs 42, and the inner walls or flanges 51 of the recesses have transverse ribs 46' thereon for engaging in the grooves 47 of the tabs as shown in FIG. 8. The end wall 49 has a rearwardly directed top flange 52 and side flanges 53, and ears 54 extend laterally from the upper portions of side flanges 53 for fitting above the ears 41 at the front edge of the bottom wall 39 of the trough when inner walls 51 of the recesses 50 are engaged in the grooves 44 behind tabs 42.

The improved combination tiered letter tray and vertical file trough provides a flexible arrangement in which the tiered trays can be used alone or in combination with one or more file troughs, and the file troughs can be used singly or in multiple apart from the letter trays with an improved end cap for the open side of a trough. The letter trays are detachably and stably supported by the improved riser members which have upper and lower tabs slidably engaged in grooves in the inner surfaces of the side walls of the trays. Obviously, additional letter trays may be tiered above the two trays shown by means of additional riser members.

By providing tabs and slots on the improved vertical file troughs at the same spacing as the slots in the letter trays, a file trough is quickly and easily connectible to the bottom letter tray, and one or more like troughs are quickly and easily connectible to said first trough in laterally adjoining relation.

The improved combination tiered letter tray and vertical file is simple and inexpensive to manufacture, pleasing in appearance and quickly and effectively useful separately and in multiple.

We claim:

1. A combination tiered letter tray and vertical file comprising at least two tiered U-shaped trays each having a bottom wall and side walls with equally spaced-apart slots at the intersections thereof, riser plate members supporting the upper tray on the lower tray and having a bottom groove detachably engaged over the side wall of the lower tray and upper tabs detachably engaged in the slots of the upper tray, and a vertical file comprising at least one L-shaped trough having a bottom wall and side wall with spaced-apart slots at the intersection thereof and spaced-apart upright tabs at the opposite edge of its bottom wall, the upright tabs of said trough being spaced apart the same distance as the slots in the trays and detachably engaged in the slots at one side of said lower tray and the slots of said trough being spaced apart the same distance so as selectively to receive the upright tabs of a like trough in laterally adjoining relation.

2. A combination tiered letter tray and vertical file as defined in claim 1, wherein the riser plate members each have a front plate and upper and lower tabs spaced rearwardly from the front plate to form top and bottom grooves therebetween.

3. A combination tiered letter tray and vertical file as defined in claim 1, wherein the spaced upright tabs on the L-shaped trough are spaced outwardly away from the edge of its bottom wall to form grooves for embracing the bottom portion of a side wall of another trough.

4. A combination tiered letter tray and vertical file as defined in claim 3, wherein additional tabs at said opposite edge of the bottom wall of said trough are positioned to abut the exterior of a side wall in said groove.

5. A combination tiered letter tray and vertical file as defined in claim 1, wherein an end cap is provided for selectively embracing the upright tabs of said trough when used apart from said letter tray.

6. A combination tiered letter tray and vertical file as defined in claim 2, wherein the spaced upright tabs on the L-shaped trough are spaced outwardly away from the edge of its bottom wall to form a groove for embracing the bottom portion of a side wall adjacent to the tabs.

7. A combination tiered letter tray and vertical file as defined in claim 6, wherein additional tabs at said opposite edge of the bottom wall of said trough are positioned to abut the exterior of a side wall in said groove.

8. A combination tiered letter tray and vertical file as defined in claim 1, wherein the upper tabs on said riser plate members slidably contact the inner surface of the adjacent side wall of the upper tray and the upright tabs of said trough slidably contact the inner surface of the adjacent side wall of the lower tray.

9. A combination tiered letter tray and vertical file as defined in claim 3, wherein the upper tabs on said riser plate members slidably contact the inner surface of the adjacent side wall of the upper tray and the upright tabs of said trough slidably contact the inner surface of the adjacent side wall of the lower tray.

* * * * *